US007753103B1

(12) United States Patent
Rochester

(10) Patent No.: US 7,753,103 B1
(45) Date of Patent: Jul. 13, 2010

(54) CENTRALLY GATED CAST METAL ROTARY FRICTION PLATES AND METHOD OF MANUFACTURE

(76) Inventor: William R. Rochester, 1108 Essex Dr., Auburn, IN (US) 46706

( * ) Notice: Subject to any disclaimer, the term of this patent is extended or adjusted under 35 U.S.C. 154(b) by 346 days.

(21) Appl. No.: 12/045,584

(22) Filed: Mar. 10, 2008

Related U.S. Application Data

(63) Continuation-in-part of application No. 11/345,814, filed on Feb. 2, 2006, now abandoned.

(60) Provisional application No. 60/649,407, filed on Feb. 2, 2005.

(51) Int. Cl.
*B22D 33/04* (2006.01)
*B22C 9/10* (2006.01)

(52) U.S. Cl. ..... 164/137; 164/339; 164/369

(58) Field of Classification Search ..... 164/137, 164/339, 369, 122, 133
See application file for complete search history.

(56) References Cited

U.S. PATENT DOCUMENTS

| | | | |
|---|---|---|---|
| 125,917 | A | 4/1872 | Washburn |
| 186,500 | A | 1/1877 | Sax |
| 212,087 | A | 2/1879 | Baker et al. |
| 222,922 | A | 12/1879 | Lobdell |
| 230,853 | A | 8/1880 | Baker |
| 303,773 | A | 8/1884 | Wiesing |
| 1,457,362 | A | 6/1923 | Goens |
| 2,138,624 | A | 11/1938 | Campbell et al. |
| 5,503,214 | A | 4/1996 | Cribley et al. |
| 5,862,892 | A | 1/1999 | Conley |
| 2004/0149420 | A1 | 8/2004 | Meroni et al. |

*Primary Examiner*—Kevin P Kerns
(74) *Attorney, Agent, or Firm*—Robert L. Stearns; Dickinson Wright, PLLC

(57) ABSTRACT

A method of casting a rotary friction plate includes preparing a casting mold with a cavity and a core shaped to form the friction plate. Molten metal is poured into the mold through a central sprue where a portion of the metal flows radially outward across the top of the core to fill friction plate forming regions of the cavity from above, while another portion flows through a central opening in the core to fill a hub forming region at the bottom of the cavity as well as additionally supply metal to the lower friction plate forming region from below. The metal is allowed to cool, which begins at the radially outer regions of the at least one friction surface and progresses radially inward to develop a uniform cast structure.

14 Claims, 5 Drawing Sheets

CENTRALLY GATED CAST METAL ROTARY FRICTION PLATES AND METHOD OF MANUFACTURE

This application is a Continuation-in-Part and claims priority to U.S. Provisional Patent Application Ser. No. 60/649,407, filed Feb. 2, 2005 and U.S. patent application Ser. No. 11/345,814, filed Feb. 2, 2006 now abandoned, both which are incorporated herein by reference.

BACKGROUND OF THE INVENTION

1. Technical Field

This invention relates generally to metal casting and more particularly to controlling heat flow and solidification during casting.

2. Related Art

There are problems in automotive circles today of irregular friction reaction and vibration of rotary friction disc brake rotor and clutch plates that are a direct result from the way in which they are cast. These components are typically cast in vertically split molds with the friction plate oriented vertically and filled through a bottom inlet gate so that the mold cavity is filled from the bottom up. Regardless of where the molten metal enters the vertical mold cavity, gravity causes the low side to fill first and proceeds up and across the casting, developing different thermal gradients as it fills, and thereby setting up different solidification rates of the metal in the cavity, with the first metal introduced eventually rising in the mold cavity to the top and becoming the coolest, and the last metal introduced being at the bottom adjacent the bottom gate and being the hottest of the metal. To make matters worse, there is a riser at the top of the mold. This riser constitutes a mass of molten metal that is the last to solidify, and it sits at the top of the mold adjacent the top of the cavity, and thus creates another hot spot in the center of the cooler upper portion of the. The severe thermal gradient causes the metal to solidify at different rates and yields a variation in the microstructure and stresses around the mass of the casting and friction face(s) of the casting, with the hotter regions being relatively softer than the cooler regions as a direct result of a relatively slower solidification rate of the hotter regions. The relative soft and hard regions in the circumferential direction of a rotary friction plate cause irregular wear, strength and braking resistance over the life of the rotary friction element. The most noticeable result in brake discs is an undesirable pulsing feel of the brakes as the operator of the vehicle slows the vehicle, rather than a smooth, even braking feel.

When friction plates are cast horizontally and gated from the outside perimeter, the problem is less noticeable as the thermal gradients are less pronounced. External inlets and risers around the mold cavity develop similar irregularities but it is the way to get molten metal into more than one region of the mold cavity and gradients tend to blend as they mix across the horizontal surfaces. These thermal gradients during solidification cause uneven structure by areas. Areas of flow through inlets accumulate and contain relatively high temperatures. Areas with heat and high liquid head pressure can move mold walls under these conditions. Areas of riser feed paths are required to maintain relatively high temperatures to compensate for liquid cooling. Areas between the higher temperatures start to solidify well ahead of hotter areas. Irregular temperatures from area to area promote differentials in solidification rates which promote differences in graphite flake size, grain size and hardness as well as variable strengths and stresses which can lead to distortion when relieved with heating and cooling of repeated function or come apart in the soft and relatively weak areas.

Complaints from automotive customers create a necessity and opportunity to find a way to improve the system or eliminate the problem. Any casting that is used as a rotating component is sensitive to variations in microstructure and properties. Several attempts have been made to modify present systems of casting and have improved the situation somewhat but have failed to eliminate the cast structure variation because they still use the vertical (on edge) orientation or widespread inlets and outside inward feeding around horizontal orientation.

SUMMARY OF THE INVENTION

To eliminate this problem I have considered the gating (filling) system, the casting cavity and the mold immediately surrounding this molten metal as one mass of heat by the time the mold is poured. This was the basis for a design of a gating system to develop one natural, centralized thermal gradient from highest temperature at center of the mass to lower temperature around perimeter of mass for directional solidification from relatively cool perimeter back to hottest mass at center. This design fills the mold cavity in a horizontal position working with gravity to flow evenly throughout the cavity from the inside outward while maintaining a low profile for low head pressure to minimize potential mold wall movement which lends to a balance problem. Controlling the flow of the metal in the mold during the pour in order to provide a generally even fill and generally balanced temperature of the metal through appropriate orientation, gating and coring of the mold sets up the ability to control the solidification of the material from the outer perimeter inward to develop the desired uniform properties of the casting. This is particularly beneficial for brake rotor applications, where a uniform microstructure in the radial and circumferential direction on the friction faces of the rotor plates produces a corresponding uniform braking behavior when engaged by the brake pads to greatly reduce or all together eliminate brake pulsing and/or chatter otherwise caused by uneven wear of the friction faces due to hard and soft regions of the friction plates resulting from conventional casting techniques.

According to one aspect of the invention, a method is provided of casting a rotor friction plate, and particularly a disc brake rotor for a vehicle braking system in which the rotor includes a central mounting hub portion and a pair of friction plates carried by the mounting hub and connected to one another through a plurality of spaced ribs. A casting mold is prepared having a mold cavity, a core and a sprue to provide a passage for introducing molten metal into the mold. The cavity is horizontally arranged, such that the friction plates of the rotor cast within the mold are generally horizontally disposed and with the mounting hub directed downwardly in the mold. The mold cavity has a central axis corresponding to that of the brake rotor. The sprue is centrally arranged such that metal is poured and enters the mold cavity from above along the central axis of the mold cavity. The core has a top face that extends radially outwardly from the central axis and also a bore that extends through the core along the central axis to an opposite lower face of the core. The top face of the core is spaced from the upper wall of the mold cavity. The core is formed with an annular wall that projects upwardly from the top face of the core in radially outwardly spaced relation to the sprue to provide a cup-like primary distribution reservoir for molten metal within the mold immediately adjacent the sprue. The top of the wall engages the upper surface of the mold cavity, but there are recesses formed in the top wall at circumferentially locations to provide choked openings in the wall. The core includes a plurality of radially extending circumferentially spaced lugs projecting radially outwardly of the wall on either side of each of the openings. The lugs extend to the inner perimeter of the upper friction plate forming region. The mold cavity wall engages the tops of the lugs and extends across the space between the lugs. The mold cavity wall also engages the radially outer surface of the lugs to enclose a plurality of circumferentially spaced block shaped secondary distribution reservoirs radially outwardly of the primary distribution reservoir and communicating with corresponding ones of the openings in the wall. Between the lugs, the mold cavity steps radially out a small distance to form a small gap near the bottom of each secondary distribution reservoirs, defining a plurality of circumferentially spaced choked inlets that lead from the secondary distribution reservoirs directly into the upper friction plate region of the mold cavity.

During the pour, the primary and secondary reservoirs fill with molten metal and remain filled and replenished with hot metal throughout the pour, as metal from the primary and secondary reservoirs is fed at a controlled rate into the upper friction plate forming region through the choked inlets. As the metal enters the upper most friction plate region, it flows outward and downward. The upper and lower friction plate regions are separated by an annular disc shaped vent forming portion of the core. The vent forming portion is formed with a plurality of spaced holes that communicate with the upper and lower friction plate forming regions. The molten metal entering the upper friction plate region is caused to flow by gravity downwardly through the plurality of holes and into the lower friction plate region. The metal that eventually solidifies in the holes corresponds to a plurality of ribs or fins that interconnect the friction plates in the completed casting. While the cavity fills primarily from above through the distribution reservoir, a relatively smaller fraction of the molten metal from the sprue passes downward through the central opening in the core and is gated at the bottom radially outwardly to simultaneously supply a flow of molten metal into the hub region of the brake rotor at the bottom of the cavity which connects directly to the lower friction plate forming region of the mold. The small fraction of molten metal fed from below serves to supplement the primary feed from above and also keeps the metal in the lower regions of the mold cavity hot during the pour, as well as serving to cushion the down flow of the molten metal from above. Eventually, the top and bottom directed flow of molten metal fills the cavity. With the controlled pour and balanced heat flow upon filling, the metal can begin to solidify, which commences from the outer perimeter and progresses radially inward at a uniform rate to establish a uniform cast structure.

Some of the advantages of the present invention include the ability to control the flow of metal so that the velocity of the molten metal is dramatically reduced from that of the initial pour as it enters the friction plate regions of the cavity. Also, the shortest flow distance is employed by going across the top of the core and directly into the upper most friction plate region. The central fill controls heat dissipation as a thermal gradient develops from the heat source to the heat escape near the outer boundaries of the casting cavity. The centralized heat mass also serves as a source of molten metal to feed the surrounding cast features during solidification in order to make sound castings.

The secondary and primary distribution reservoirs have the advantage of receiving a steady stream of the hottest metal from the sprue throughout the pour, and are thus the last of the molten metal to solidify apart from the sprue. As such, the secondary reservoirs serve as a plurality of circumferentially spaced risers that continue to feed molten metal to the mold cavity as it solidifies from the outer perimeter inward to make a sound cast structure with uniform microstructure and properties.

Another advantage of the primary and secondary distribution reservoirs is that they serve to trap any dross in the molten metal stream before it enters the casting cavity. The wall of the primary distribution reservoir acts as a dam to hold back dross as the metal enters the secondary distribution reservoirs. The choked bottom inlet of the secondary distribution reservoirs act as weirs to trap any remaining dross before the metal enters the cavity into the upper friction plate forming region. As such, the metal of the final casting is very clean and generally free of impurities.

According to a further aspect of the invention, two or more brake rotors can be cast simultaneously in the mold by stacking the mold cavities vertically and with the central openings in the cores aligned and in open communication with the sprue at the top. As the metal is poured into the mold, the metal begins to fill the upper most mold cavity in the manner described above, but also a fraction of the stream travels through the central openings in the cores and simultaneously fills the lower mold cavities in the same manner. The size and shape of the openings in the cores can be varied to choke the flow from the sprue and thus control the rate of delivery of molten metal to the molds. In this way, multiple rotors can be cast in one mold, increasing efficiency and lowering the cost of making rotors.

THE DRAWINGS

These and other features and advantages of the present invention will become more readily appreciated when considered in connection with the following detailed description and appended drawings, wherein.

DETAILED DESCRIPTION

I have cast standard brake rotors and clutch plates using this central filling system through the open center of the casting, which routes the molten metal through the inside diameter, horizontally across the short feeding distance to the outside diameter. This produces no noticeable variation around the solid casting structure as the one thermal gradient solidified in one circular flow of heat extraction. This horizontal orientation can be adapted for vertically parted molds but it best suited for horizontally parted molds, and is adaptable to all rotary friction plates and other devices where uniform development of cast metal properties is desired in the circumferential direction across the friction surfaces.

Figure 1:
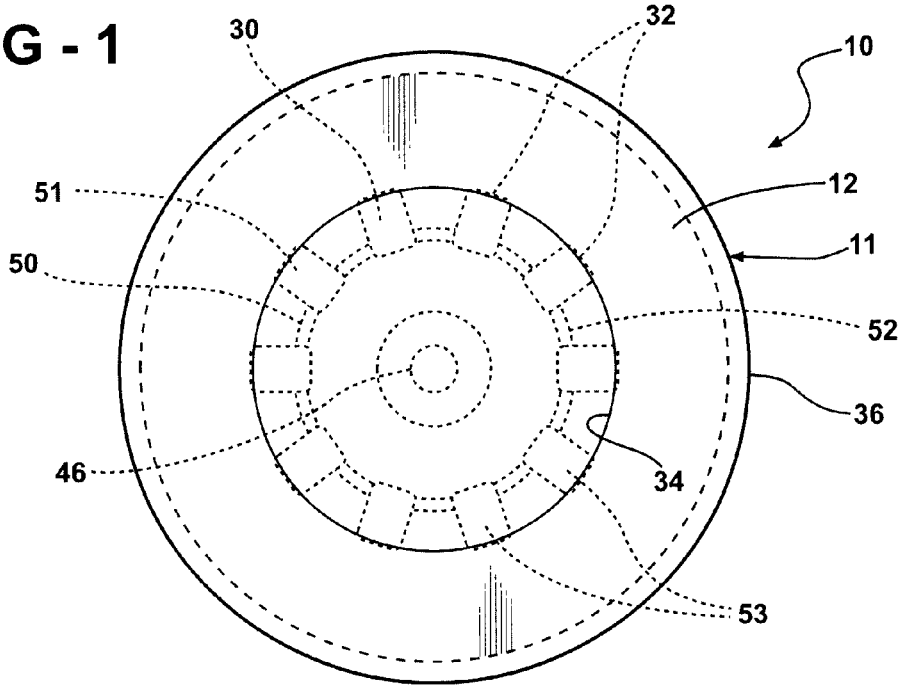
FIG. 1 is a top plan view of a rotary friction plate shown in a horizontally positioned, centrally gated casting system.
Figure 3:
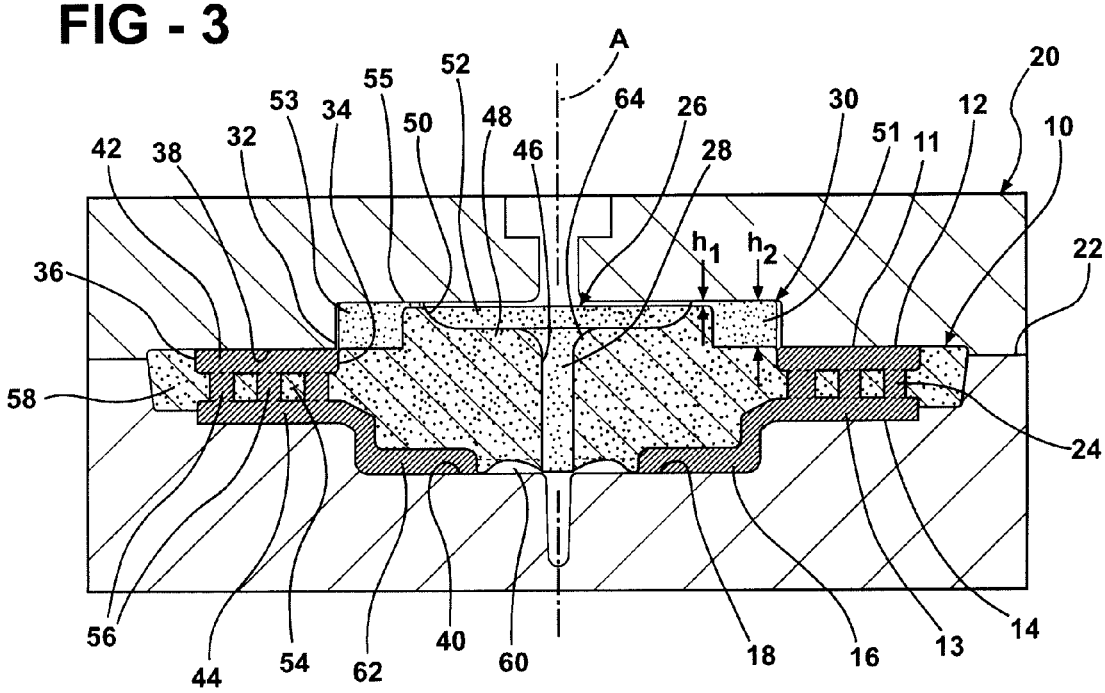
FIG. 3 is a cross-sectional view of FIG. 1, illustrating further details of the gating system.
Figure 2:
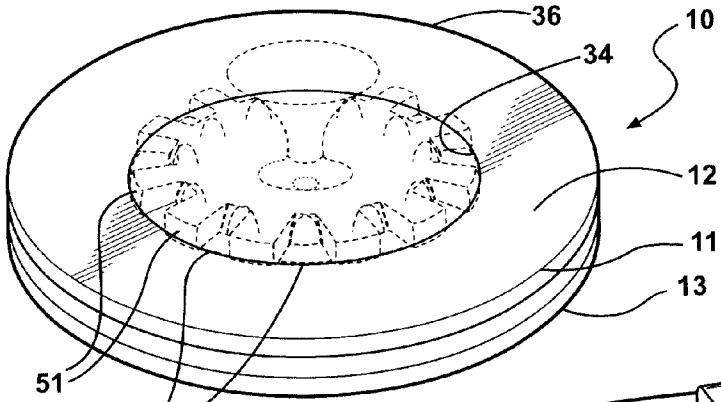
FIG. 2 is an isometric view of the rotary friction plate of FIG. 1 showing further details of the gating system.

The way I have done this is to use the horizontal orientation of the mold cavity but pour all the melt in through a central gating and outward through the cavity, (not from outside inward) of the volume to be cast, through several closely positioned inlets on the shorter inside diameter. This is illustrated in FIGS. 1-3 where rotary friction member 10 is shown with its opposite friction faces 12, 14 oriented horizontally and coupled to a central mounting hub 16 (in the case of a brake rotor, for example). The member 10 is positioned in a mold cavity 18 of a mold 20 which is preferably but not necessarily parted along a horizontal parting plane 22. The mold parts could be split along a vertical parting plane (not shown, but understood by those of ordinary skill in the art). The friction faces 12, 14 may be connected to one another through a series of circumferentially spaced ribs 24 in known manner. The ribs 24 can take on any of a number of shapes, sizes, orientation and patterns which are dictated by the designer, such as fins, posts, etc. The particular size, shape pattern, etc. of the ribs are not important to making a casting according to the present invention. It will also be appreciated that in the case of a clutch plate, for example, there may be only one friction face and no ribs, but a clutch plate may nonetheless benefit from being cast by the method of the present invention to produce a cast structure with uniform cast properties.

The central gating system is generally indicated at 26. It includes a central sprue 28 that feeds metal into the mold 20 along the central axis of the member 10. A core 30 may be positioned within the mold cavity 18 and occupies those regions of the mold cavity 18 that are not to be filled with metal to form the rotary friction member 10. The core 30 may also serve to route the flow of metal in the mold 20. In the illustrated embodiment, metal from the central sprue 28 is gated radially outward across the top of the core 30 to a plurality of circumferentially spaced inlets 32 into the uncored open regions of the mold cavity 18 that, once filled with metal, defines the member 10. These inlets 32 are on the inside diameter 34 of the friction faces 12, 14. From there, the metal flows outward toward the outer diameter 36 of the friction faces 12, 14. In addition to serving as the source of inflowing molten metal, the central sprue 28 and gating system 26 serves as continual heat riser after the mold is initially filled to continue feeding molten metal during solidification shrinkage to develop sound castings. Thus this develops and maintains a mass of centralized heat to hold the last metal into the gating system 26 as liquid, while developing a natural, radial thermal gradient to compensating for liquid cooling contraction in the casting.

The metal reaching the outer diameter 36 has given up a lot of heat to the mold and will start to solidify first around the perimeter where there exists a higher ratio of surface area to volume of the hot metal which extracts heat faster than a lower ratio as in the center area. This phenomenon starts the progression of solidification around the perimeter, radially in the direction of the remaining hotter mass in the center of the mold. The gating system 26 is still hot and liquid enough to compensate for the liquid contraction of the cooling metal as the front of solidification progresses toward the hot center, until it reaches the inside diameter of the casting establishing an evenly homogenous structure throughout the casting. As a result, there is little if any variation in properties in the circumferential direction across the friction faces that would otherwise normally be associated with uneven braking or clutching action of the rotary friction member 10.

With the process directed more specifically to the casting of a vented brake disc rotor 10, and as illustrated in FIGS. 1-3 as well as FIGS. 4-9, a typical rotor 10 has the central hat or hub 16 which supports a pair of friction plates 11, 13 whose outer surfaces face in opposite directions and define the friction faces 12, 14, with one of the faces 12 facing away from the direction of the hub 16 and the opposite face 14 facing toward the direction of the hub 16.

With reference to the horizontal orientation of the rotor as it is cast in the mold 20 (FIG. 3), the hub 16 is positioned facing downwardly in the mold 20, the friction plate 11 that is opposite the hub is arranged to be the uppermost plate in the mold, and the other friction plate 13 is positioned below the plate 11. The friction faces 12, 14 are formed by upper and lower wall surfaces 38, 40 of the mold cavity 18 in the region of the upper and lower friction plate regions 42, 44 of the mold cavity, respectively. The friction faces 12, 14 and their associated wall surfaces 38, 40 are horizontally arranged and are parallel to one another.

The brake rotor 10 has a central axis that is coaxial with a central axis A of the mold 20. The sprue 28 is centrally located and is coaxial with the axis A of the mold 20.

Referring to FIGS. 3-9, the core 30 is made of a reducible material, such as compacted sand or refractory with a resin binder or the like, and is made separately from the mold 20. The core 30 may have a central opening 46 which is coaxial with the axis A when positioned in the mold 20. The core 30 has an upper surface 48 that extends radially outward from the opening 46 to a raised circumferential wall 50 that defines within its perimeter a cup-shaped primary distribution reservoir 52 surrounding the sprue 28 and central opening 46. The wall 50 is spaced radially outwardly from the sprue 28. When positioned in the mold 20, the upper surface 48 of the core 30 is spaced from the upper mold wall 38 such that the primary distribution reservoir 52 is covered by the mold wall, but the reservoir 52 remains open to receive molten metal fed into the mold 20 from the sprue 28. The wall 50 is configured relative to the mold wall to pool the molten metal so that it dwells for a time in the primary reservoir 52 before passing out of the primary reservoir 52 to a plurality of radially extending, circumferentially spaced secondary reservoirs 53 radially outward of the wall 50 and radially inward of the upper friction plate forming portion 42.

Figure 9:
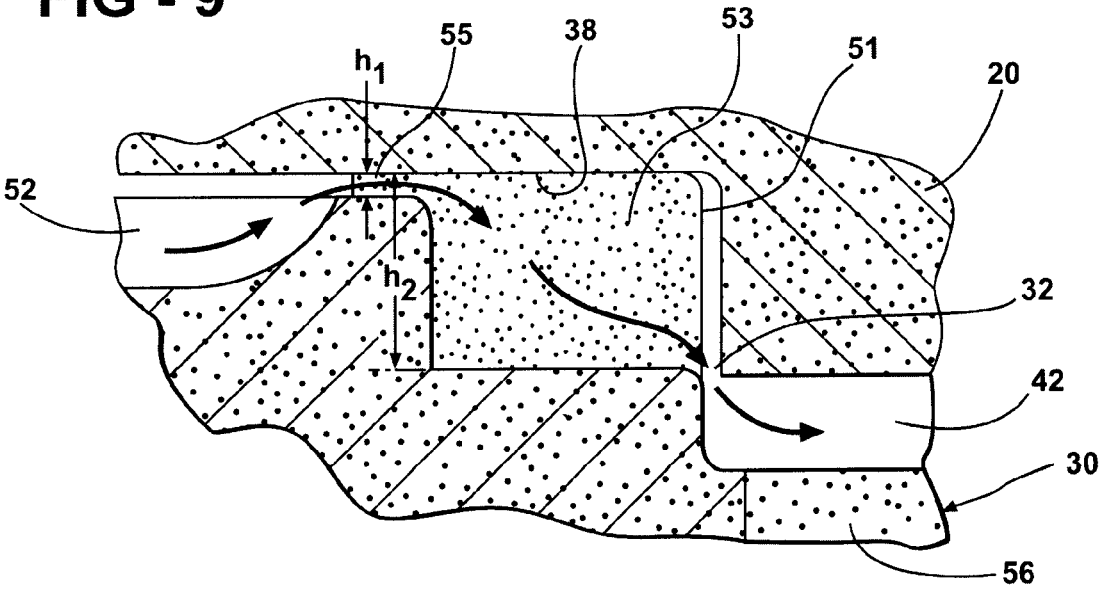
FIG. 9 is a view like FIG. 8, but showing flow of molten metal of FIG. 5.

With continued reference to FIGS. 3-9, it will be seen that the wall 50 has circumferentially spaced gaps or openings 55 in the top of the wall where the height of the wall is locally decreased. As the metal in the primary reservoir 52 rises to the top of the wall 50, it overflows through the openings 55 and into the channel-like secondary reservoirs 53. The gaps in the wall that serve as the openings 55 have a height h1 which is less than the height h2 of the wall 50. In this way, the molten metal in the primary distribution reservoir 52 must flow up and over the wall 50 through the choked openings 55 in the manner of a dam, to slow and quiet the flow of the metal as well as to trap dross in the molten metal that may have entered the reservoir 52 from the sprue 28. The core 30 is formed with a plurality of circumferentially spaced block portions or lugs 51 that extend radially outwardly on either side of the openings 55 and provide circumferentially spaced, radially extending guide channels or shoots. The upper mold wall 38 extends tight across the top of the lugs 51 and around the outer sides of the lugs 51, as detailed in FIGS. 8 and 9 to cover the channels and define the plurality of circumferentially spaced, radially extending secondary distribution reservoirs 53. As best illustrated in FIG. 9, the mold wall 38 projects radially outward of the core 30 at the secondary distribution reservoirs 53 to create a small gap near the bottom of each secondary reservoir 53. The gaps serve as the choked inlets 32 for feeding molten metal from the secondary reservoirs 53 directly into the upper friction plate forming regions 42 of the mold cavity 18 and are located at the inner perimeter 34 of the region 42. Any dross that carried over from the primary reservoir 52 into the secondary reservoir 53 is trapped in the secondary reservoirs 53 before entering the cavity 18 through the inlets 32. The metal flowing through the reservoirs 52, 53 thus pass through two choke points 55, 32 which serves to clean the metal, settles the flow and creates holding points for hot iron that later serve as risers during solidification to feed shrinkage.

Figure 4:
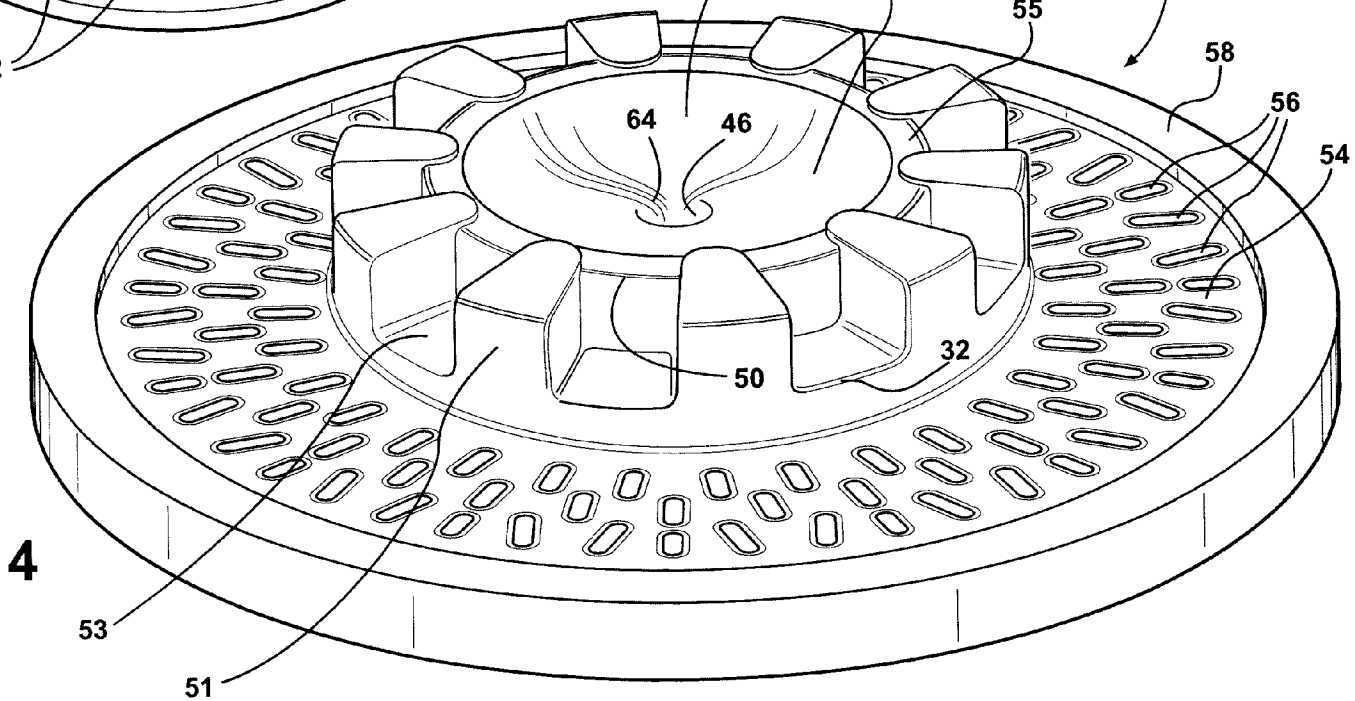
FIG. 4 is a perspective view of the core used to make the friction plate of FIGS. 1-3.

As shown best in FIGS. 3 and 4, the core 30 has a vent forming disc portion 54 that extends between and separates the upper and lower friction plate regions 42, 44 to form the vented part of the brake disc between the friction plates 11, 13 in the finished casting. The portion 54 includes a plurality of spaced holes 56 that establish direct flow communication between the upper and lower friction plate regions 42, 44, such that when metal is introduced into the upper region 42, at least a fraction of the flow is caused by gravity to flow downward into the lower region 44 through the numerous holes 56. The metal that eventually solidifies in the holes forms the ribs 24 of the finished rotor 10. A mounting ring 58 is formed at the outer perimeter 46 of the core 30 and is clamped between the mold parts across the parting plane 22 when the core 30 is mounted in the mold 20.

Figure 6:
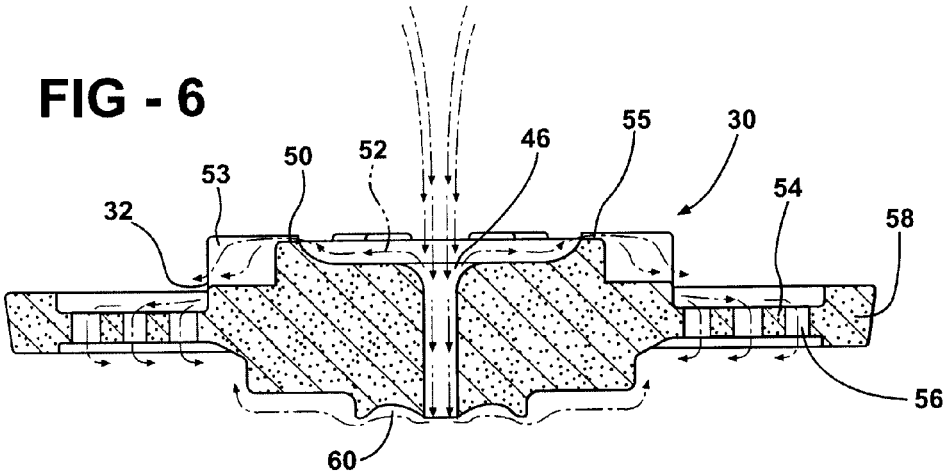
FIG. 6 is an elevation view of FIG. 5 further showing the flow path of the metal.
Figure 7:
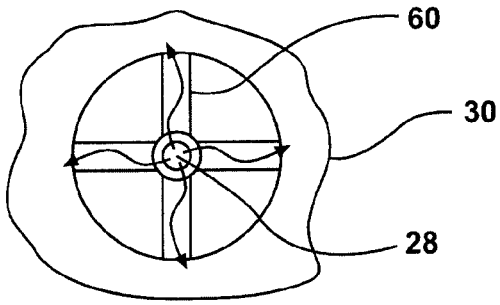
FIG. 7 is a bottom view of FIG. 6 illustrating the bottom gating.
Figure 8:
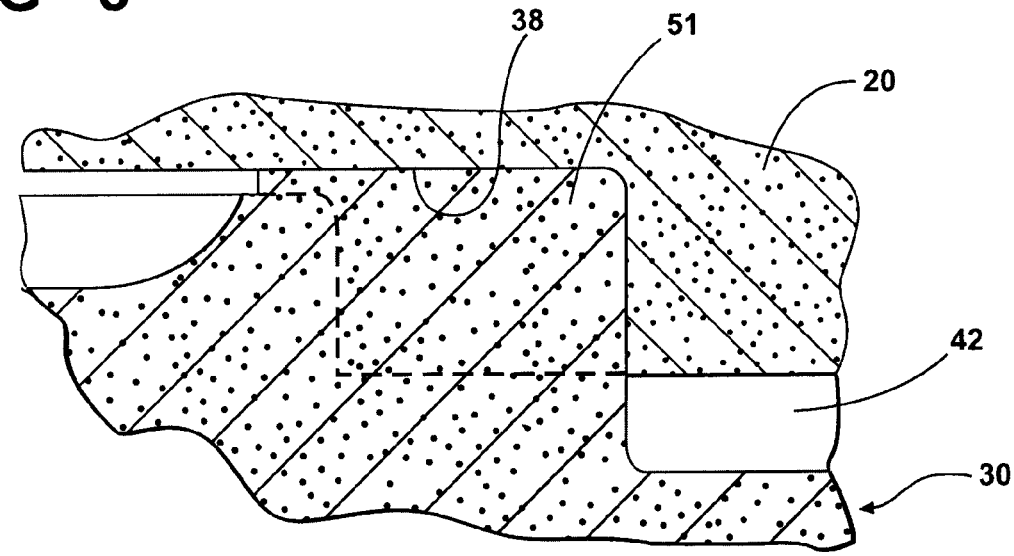
FIG. 8 is an enlarged fragmentary sectional view of FIG. 4, but showing the core in the mold.

The central opening 46 in the core 30, being in direct communication with the sprue 28, directs a small fraction (e.g., 10-20%) of the molten metal through the center of the core 30 toward the bottom of the mold 20, where the metal flows through a plurality of bottom gates 60 (e.g., four), as shown best in FIGS. 3, 6 and 7 that extend radially outward and connect to the hub forming region 62 of the cavity 18 to simultaneously fill the hub forming region 62 with molten metal from the bottom up. It will be seen from FIGS. 3 and 4 that the mouth 64 of central opening is tapered to encourage quite, non-turbulent flow of the molten metal during the pour. As the hub forming region 62 fills with molten metal, the metal progresses upwardly into the lower friction plate forming region 44 to help fill this region 44 from below in addition to the fill from above. The counterflow of metal from the bottom helps maintain a hot supply of metal to lower regions of the cavity 18, and also helps cushion the flow of molten metal from above.

Figure 5:
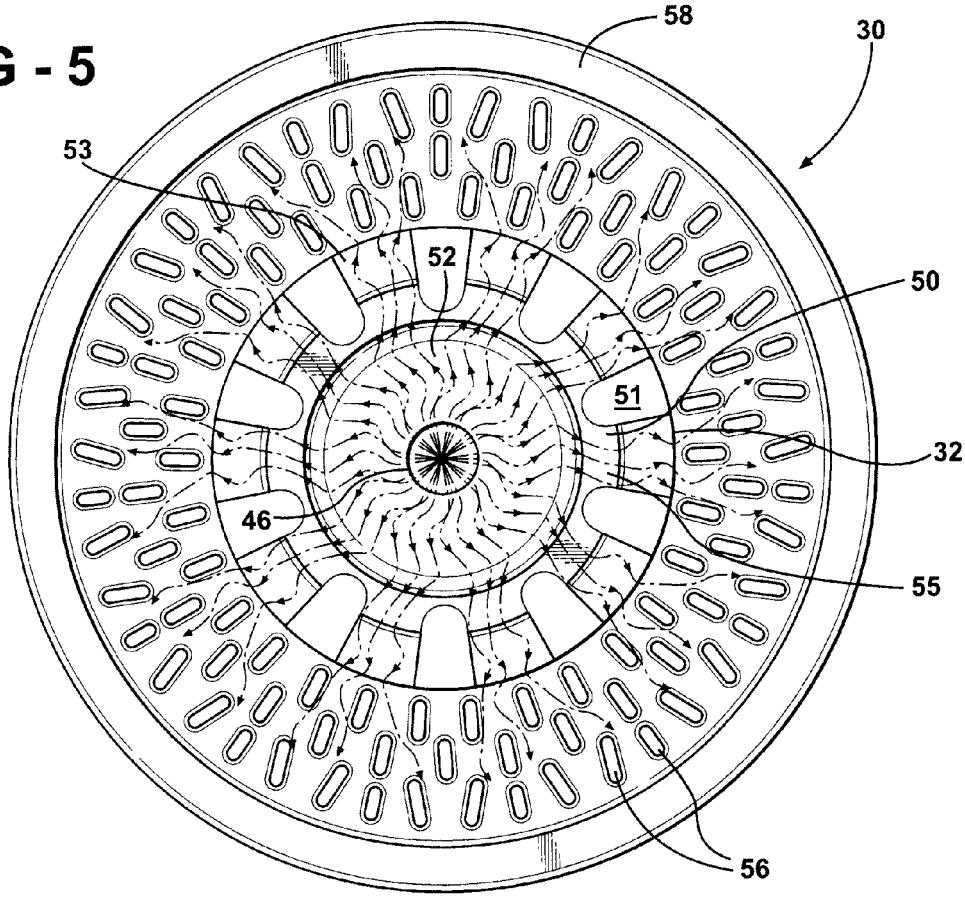
FIG. 5 is a plan view showing the flow path of metal poured into the mold.

FIGS. 5 and 6 illustrate the general flow pattern of the of the molten metal in the mold 20, where it can be seen that the mold 20 fills from above across the top of the core 30, and also from below through the central opening 46 in the core. The primary and secondary distribution reservoirs 52, 53 serve to provide a direct path across the top of the core 30 to the uppermost friction plate region 42 while also quieting the flow of the metal. Metal entering the uppermost friction plate forming region 42 begins to fill the region 42, but some of the metal flows downwardly through the holes 56 to also fill the lower friction plate region 42 from above, while at the same time a fraction of the molten metal from the sprue is directed through the central opening 46 in the core 30 to also help fill the cavity from below.

Figure 10:
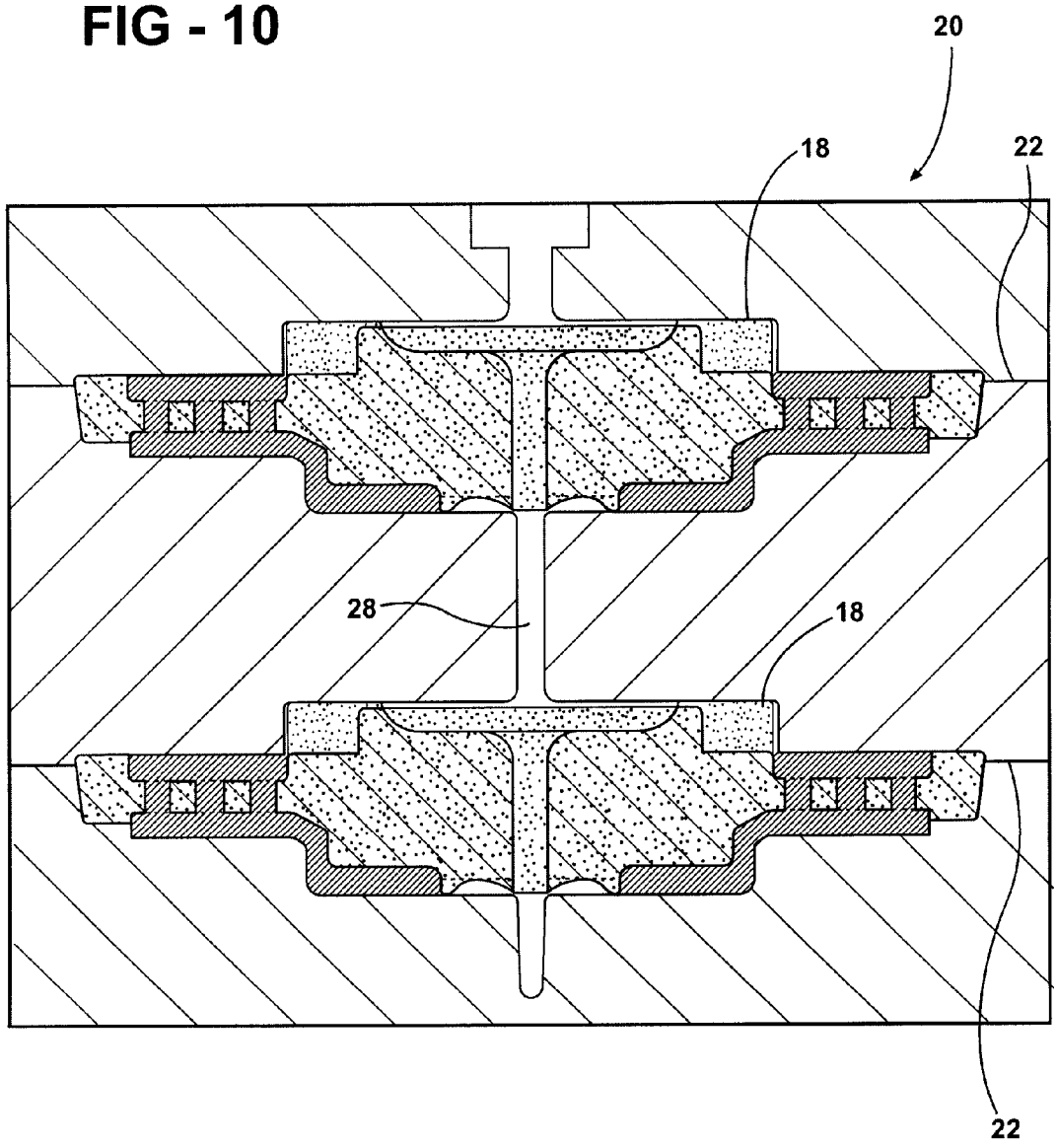
FIG. 10 is a variation in which stacked mold cavities are employed.

FIG. 10 is an embodiment in which two mold cavities 20 are stacked vertically and connected by a common central sprue 28. The size and shape of the central openings 46 and the sprue 28 can be varied to control the flow of molten metal into the mold and among the mold cavities 18 to help achieve a balanced flow of the metal and simultaneous fill of the mold cavities 18. While FIG. 10 illustrates an embodiment with two stacked molds 20, it will be appreciated, and the invention contemplates, that three or more molds could be stacked, with one limit being the ability to control the flow and temperature of the molten metal in a manner that ensures the production of sound castings of acceptable quality.

The casting mold 20 is preferably made of sand with separate mold sections that mate at the parting plane 22, and the molten metal is preferably iron. It will be seen that there are no chill blocks in the mold cavity 18 that would provide outside influence to the cooling rate of the metal in the mold 20.

Obviously, many modifications and variations of the present invention are possible in light of the above teachings. It is, therefore, to be understood that within the scope of the appended claims, the invention may be practiced otherwise than as specifically described. The invention is defined by the claims.

What is claimed is:

1. A method of casting a vented rotary friction plate having a central hub portion and pair of circumferentially continuous, radially extending friction plates carried on the hub with friction faces that face opposite of one another, said method comprising:

preparing a casting core having an upper surface, an annular wall portion projecting upwardly from the upper surface in surrounding and radially outwardly spaced relation to a central opening in the core to provide a cup-shaped primary distribution reservoir on the top of the core around the central opening, a plurality of circumferentially spaced secondary distribution reservoirs disposed radially outwardly of the wall, and a vent forming disc portion radially outward of the wall portion and formed with a plurality of holes;

preparing a metal casting mold having a mold cavity configured to form the rotary friction plate and including a central sprue extending down into the mold cavity from above along a central axis of the mold cavity;

mounting the core in the casting mold with the central opening aligned axially with the sprue, and with the top wall of the core in spaced relation to an upper wall of the cavity to keep the primary distribution reservoir open and to cooperate with the wall and to provide a plurality of circumferentially spaced choked openings in the wall leading to the secondary distribution reservoirs, and with the vent forming disc portion positioned in the cavity to provide an upper friction plate region of the mold cavity and a lower friction plate region of the mold cavity, and providing a hub forming region of the mold cavity, and with the wall of the cavity further cooperating with the core to provide a plurality of circumferentially spaced choked inlets leading from the secondary distribution reservoirs into the upper friction plate forming region;

introducing molten metal into the sprue whereupon the metal flows across the upper surface of the core into the primary distribution reservoir, through the plurality of choked openings and into the plurality of secondary distribution reservoirs, and then through the plurality of choked inlets and directly into the upper friction plate forming region of the cavity where the molten metal begins to fill the upper friction forming region while some of the molten metal flows downward through the plurality of holes in the vent forming portion to begin filling the lower friction plate forming region and the hub forming region from above.

2. The method of claim 1, including further forming the core with a central opening in line with the central sprue and directing a portion of the molten metal down through the central opening in the core, into the hub-forming region and from there up into the lower friction plate forming region to additionally supply a flow of metal from below to the lower friction plate forming region.

3. The method of claim 2 wherein after the cavity is full of molten metal, stopping the pour and then allowing the molten metal to solidify from the outer perimeter of the friction plate forming regions radially inward toward the secondary and primary distribution reservoirs which are last to solidify and serve as risers to continue to feed molten metal to the cavity during solidification.

4. The method of claim 1, wherein the plurality of circumferentially spaced choked openings in the primary distribution reservoir are formed in the top of the wall and the plurality of choked inlets in the secondary distribution reservoirs are formed near the bottom of the secondary distribution reservoirs.

5. The method of claim 1 wherein when mounting the core in the mold cavity, engaging the wall of the primary distribution reservoir with the top wall of the mold cavity.

6. The method of claim 4 wherein the inlets in the wall of the distribution reservoir are formed by forming recesses in the wall at circumferentially spaced locations.

7. The method of claim 6 wherein the recesses are formed to have a height that is less than the height of the wall.

8. The method of claim 4 wherein the inlets are formed by radial gaps between the mold cavity wall and the core in the vicinity of the secondary distribution reservoirs.

9. The method of claim 1 including forming the core to include locally radially thickened lugs provided on either side of the openings and directed radially outwardly of the wall toward the upper friction plate forming region.

10. The method of claim 1 wherein the primary distribution reservoir is cup-shaped.

11. The method of claim 1 including providing two or more such mold cavities stacked vertically and joined by a common sprue and casting multiple friction plates simultaneously.

12. The method of claim 1 wherein mold cavity and core are configured so as to form a brake rotor for a vehicle.

13. A method of casting a brake rotor, comprising:

preparing a casting core having an upper surface, a central opening, an annular wall projecting upwardly from the upper surface in surrounding and radially outwardly spaced relation to the central opening to provide a cup-shaped primary distribution reservoir on the top of the core around the central opening, a plurality of circumferentially spaced openings formed in the wall, a plurality of secondary distribution reservoirs arranged radially outward of the wall in flow communication with the primary distribution reservoir through the openings, and a vent forming disc portion radially outward of the secondary distribution reservoir and formed with a plurality of holes;

preparing a casting mold with a mold cavity having shaped inner mold walls;

mounting the core in the mold cavity to define a hub forming region near the bottom of the mold cavity and upper and lower friction plate forming regions of the mold cavity;

pouring molten metal into the mold where a portion of the metal flows across the top of the core, into the primary distribution reservoir, though the openings and into the plurality of secondary distribution reservoirs, through the associated plurality of inlets and directly into the upper friction forming plate region and also through the holes in the vent forming disc portion into the lower friction plate forming region from above; and where another portion of the molten metal flows down through the central opening in the core and into the hub forming region and up into the lower friction plate forming region from below to fill the regions with molten metal; and allowing the molten metal to solidify from the outer perimeter of the casting radially inward.

14. The method of claim 13, wherein the molten metal is selected as iron.

* * * * *